United States Patent [19]

Cecchi et al.

[11] Patent Number: 4,864,272

[45] Date of Patent: Sep. 5, 1989

[54] JOYSTICK CONTROLLER

[75] Inventors: Marino Cecchi, Lincolnshire; Dean DeVolpi, Lisle, both of Ill.

[73] Assignee: Suncom, Inc., Wheeling, Ill.

[21] Appl. No.: 239,000

[22] Filed: Aug. 29, 1988

Related U.S. Application Data

[63] Continuation of Ser. No. 55,179, May 28, 1987, abandoned.

[51] Int. Cl.[4] ..... H01C 10/16

[52] U.S. Cl. ..... 338/128

[58] Field of Search ..... 338/128; 74/471 XG; 273/148 B, 150

[56] References Cited

U.S. PATENT DOCUMENTS 3,409,252 11/1968 Miller ..... 338/128 X
3,981,021 11/1975 Nichioka et al. ..... 338/128
4,469,330 9/1984 Asher ..... 338/128 X

FOREIGN PATENT DOCUMENTS 2416659 10/1974 Fed. Rep. of Germany ..... 338/128

*Primary Examiner*—E. A. Goldberg
*Assistant Examiner*—M. Lateef
*Attorney, Agent, or Firm*—Juettner Pyle Lloyd & Verbeck

[57] ABSTRACT

A joystick controller for generating analog signals representative of coordinate positions is characterized by a pair of members movable in orthogonal directions by a handle. Each member carries at least one wiper contact adapted to slide linearly along an associated linearly extending resistor carried on a circuit board to generate the signals representative of coordinate positions. The use of linearly extending resistors for generating the signals, as compared with rotary potentiometers, provides for a reduction in size of the joystick controller, economies in its manufacture, and a high degree of linearity between handle positions and the signals generated.

10 Claims, 3 Drawing Sheets

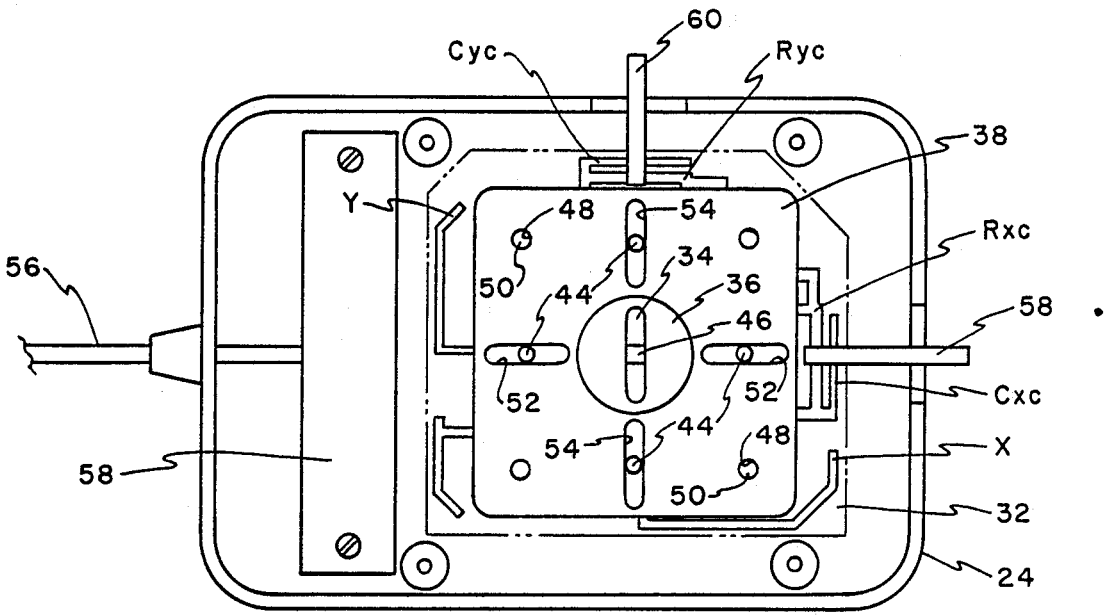
FIG. 2
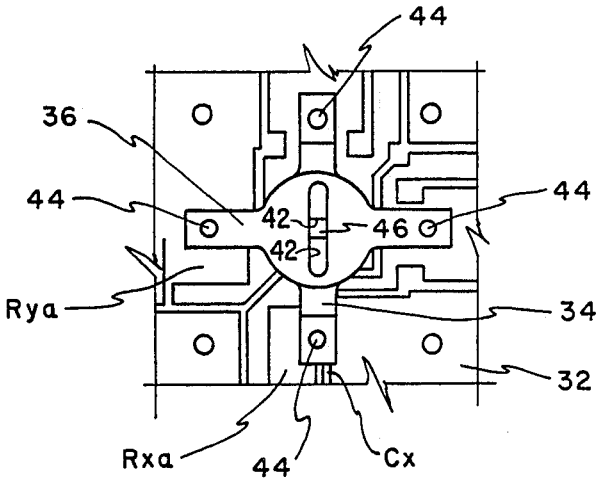
FIG. 3
FIG. 4
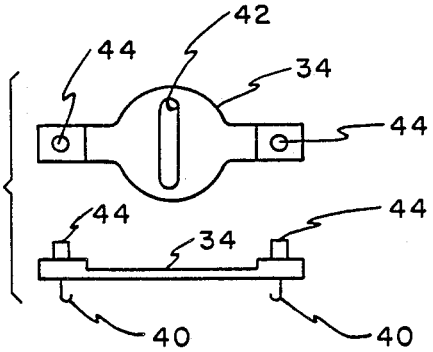

JOYSTICK CONTROLLER

This is a continuation of co-pending application Ser. No. 07/055,179 filed on May 28, 1987, abandoned.

BACKGROUND OF THE INVENTION

The present invention relates to a joystick controller for use in manually inputting coordinates and other information into computers and video equipment.

The proliferation of different types of computers and video machines by various manufacturers has been accompanied by the development of associated joysticks to control input signals used to operate such equipment. To facilitate the manual control of input coordinate information, joysticks usually have a handle simultaneously movable in two orthogonal directions to more easily and conveniently determine coordinate information in the two directions.

Known joysticks of such a type utilize internal mechanisms that are complex, expensive and result in a relatively bulky housing, such for example as rotary potentiometers, and attendant structure for converting linear motion to rotary motion, for generating coordinate information in response to handle movement. Considering that joysticks are usually coupled to equipment to be controlled, such as a computer or video game, by means of a cable, and are therefore often positioned on a table or the like in front of a monitor, a joystick housing occupying a minimum of space, and having a minimum of thickness to maximize stability against tipping, is highly desirable. Conventional joysticks that have relatively large vertical dimensions as compared to horizontal dimensions are subject to tipping, particularly when their handles have a relatively large biasing force. Also, conventional joysticks usually require a large number of parts for converting the motion of the handle to rotary motion for operating the rotary potentiometers, and are therefore subject to increased wear.

OBJECT OF THE INVENTION

The primary object of the present invention is to provide a joystick in which input coordinate information is analogically generated by linearly extending resistors, instead of by rotary potentiometers, to minimize the size and cost of the joystick.

SUMMARY OF THE INVENTION

In accordance with the present invention, a joystick controller comprises a casing; a pair of members mounted in the casing, each slidable along a linear path orthogonally with respect to the other; and a handle coupled to the casing and to the members, the handle being universally pivotable about a portion of a spherical arc to move the members linearly by an amount proportional to the component of displacement of the handle along the directions of movement of the corresponding members. Also included are a pair of transducers, each for generating a signal representative of the position of a corresponding one of the members and each including a linearly extending resistor and an electrical contactor carried by said corresponding one of said members for linear movement therewith in sliding contact with and along said resistor.

The foregoing other objects, advantages and features of the invention will become apparent upon a consideration of the following detailed description, when taken in conjunction with the accompanying drawings.

BRIEF DESCRIPTION OF THE DRAWINGS

FIG. 2 is a top plan view of the casing assembly;

FIG. 3 is a top plan view of a pair of electrical brush carrying members of the casing assembly, that are movable orthogonally with respect to each other;

FIG. 4 illustrates further structural details of a brush carrying member;

DETAILED DESCRIPTION

Figure 1:
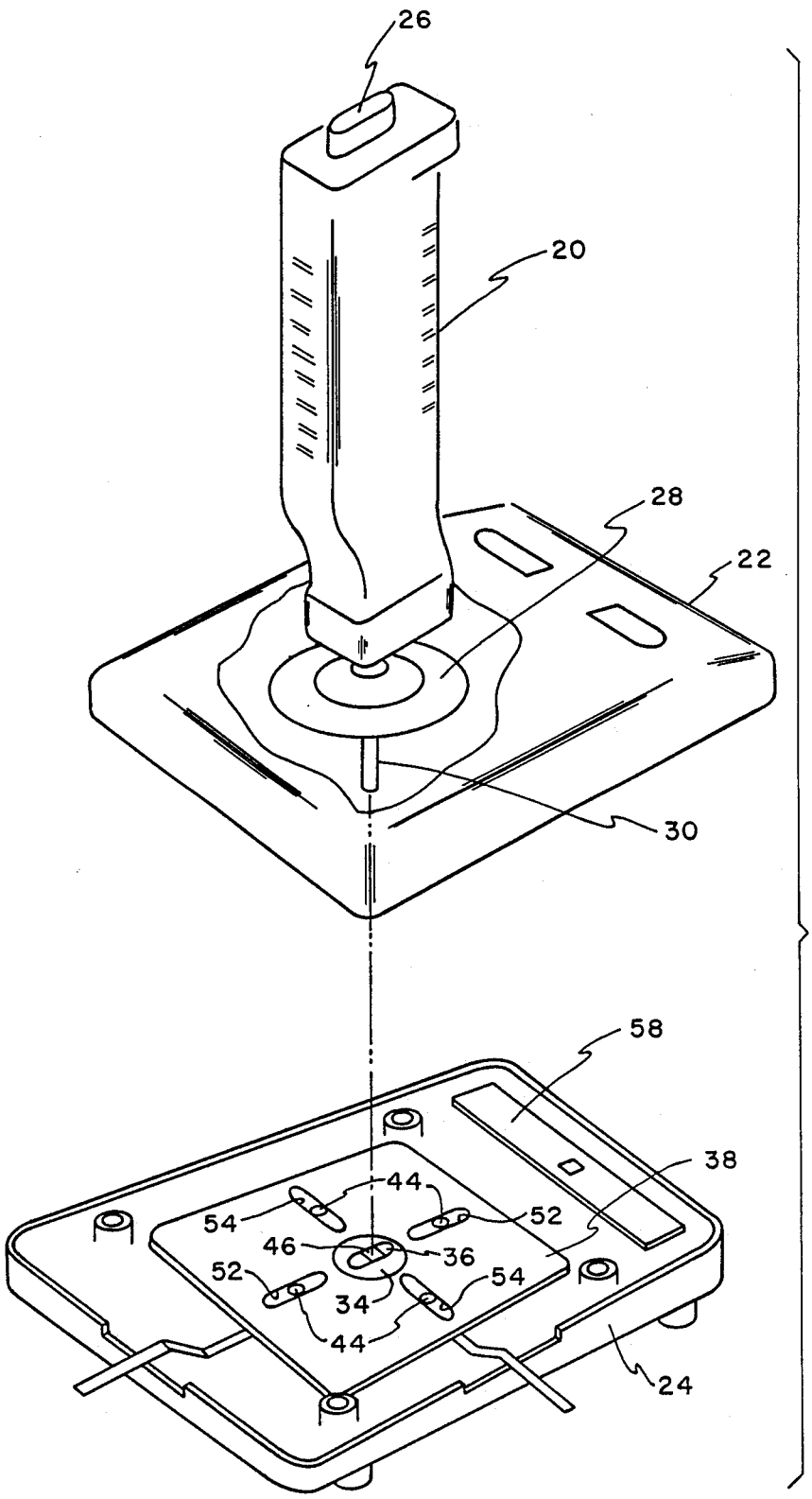
FIG. 1 is a perspective exploded view showing a handle and main casing portion of a joystick of a type with which the present invention may be used.

The joystick controller in FIG. 1 includes a handle 20 carried in an upper casing 22 that connects to a lower casing 24 to form the joystick assembly. The handle includes a microswitch button 26 at its upper end, and is mounted toward its lower end within the upper casing by a resilient member 28 that permits manual pivotal motion of the handle in a spherical arc, but returns the handle to a neutral position when the handle is released. The resilient member defines a pivot for the handle, and a brush member actuating rod 30 extends downwardly from a lower end of the handle.

Referring also to FIGS. 2–4, the lower casing 24 contains an assembly comprising, in ascending order from bottom to top, a circuit board 32, a first brush carrying member or plate 34, a second brush carrying member or plate 36 and a plate guide 38. Each plate 34 and 36 carries at its opposite ends a pair of electrical brushes 40, and the plates are arranged in superposed orthogonal relationship on the circuit board 32, so that one brush 40 of each plate contacts a resistor on the circuit board while the other remains idle and does not serve any electrical function. Rather, the other brushes support opposite ends of the plates to maintain the plates parallel to the circuit board and simplify assembly of the joystick controller by eliminating the need to orient the plates in one direction only.

Each plate 34 and 36 has an enlarged and generally circular center portion in which is provided an elongate slot 42 extending perpendicular to the length of the plate. Each also has a pair of upstanding posts 44 at its opposite ends, and with the plates arranged in orthogonal superposed relationship on the circuit board 32 with the posts facing up, the slots 42 define a common passage 46 through which the brush plate actuating rod 30 of the handle 20 is extended when the upper casing 22 is assembled on the lower casing 24.

The brush plates 34 and 36 are therefore movable in response to movement of the handle 20, and to constrain them for orthogonal movement with respect to each other, the plate guide 38 has a plurality of passages 48 that receive pins 50 extending upwardly from the circuit board 32 to orient the guide plate above the circuit board and brush carrying plates 34 and 36. Also formed in the plate guide are a pair of aligned slots 52 that receive respective ones of the pins 44 of the brush plate 36 and a pair of aligned slots 54, oriented orthogonally to the slots 52, that receive respective ones of the pins 44 of the brush plate 34. The plate guide therefore constrains the brush carrying plates for movement along straight line orthogonal paths in response to manipulation of the handle. As will be described, as the brush plates move along their straight line paths, one electrical brush 40 of each sweeps across and contacts an associated linearly extending resistor on the circuit board 32 to provide signals representative of the position of the handle 20. The signals are carried to equipment such as a computer or video game over a cable 56 that connects with outputs from the circuit board via an intermediate terminal block 58.

Figure 5:
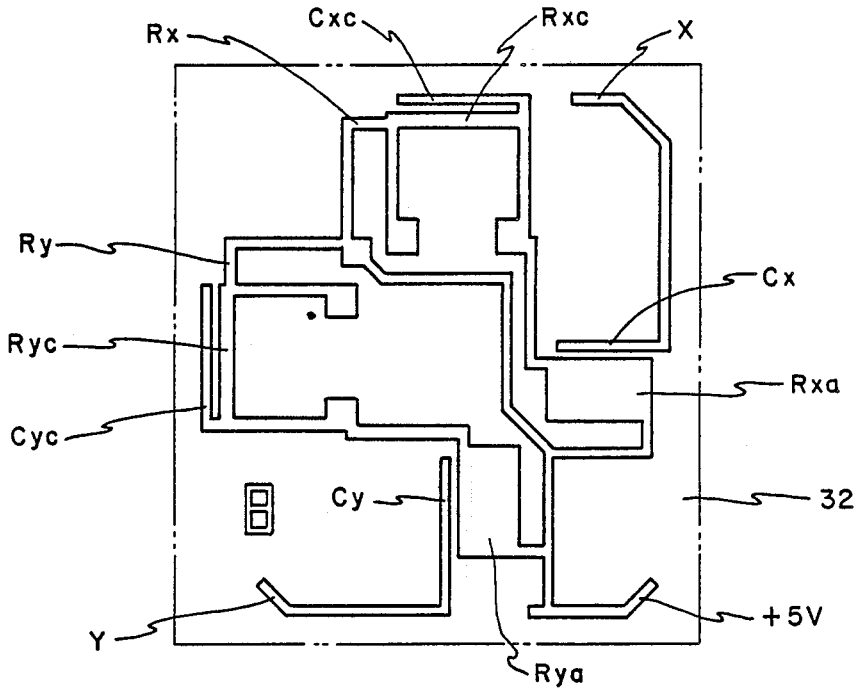
FIG. 5 is a top plan view of a circuit board of the casing assembly, illustrating linearly extending resistors that are contacted by brushes of the members to generate analog signals representing coordinate information in two orthogonal directions.
Figure 6:
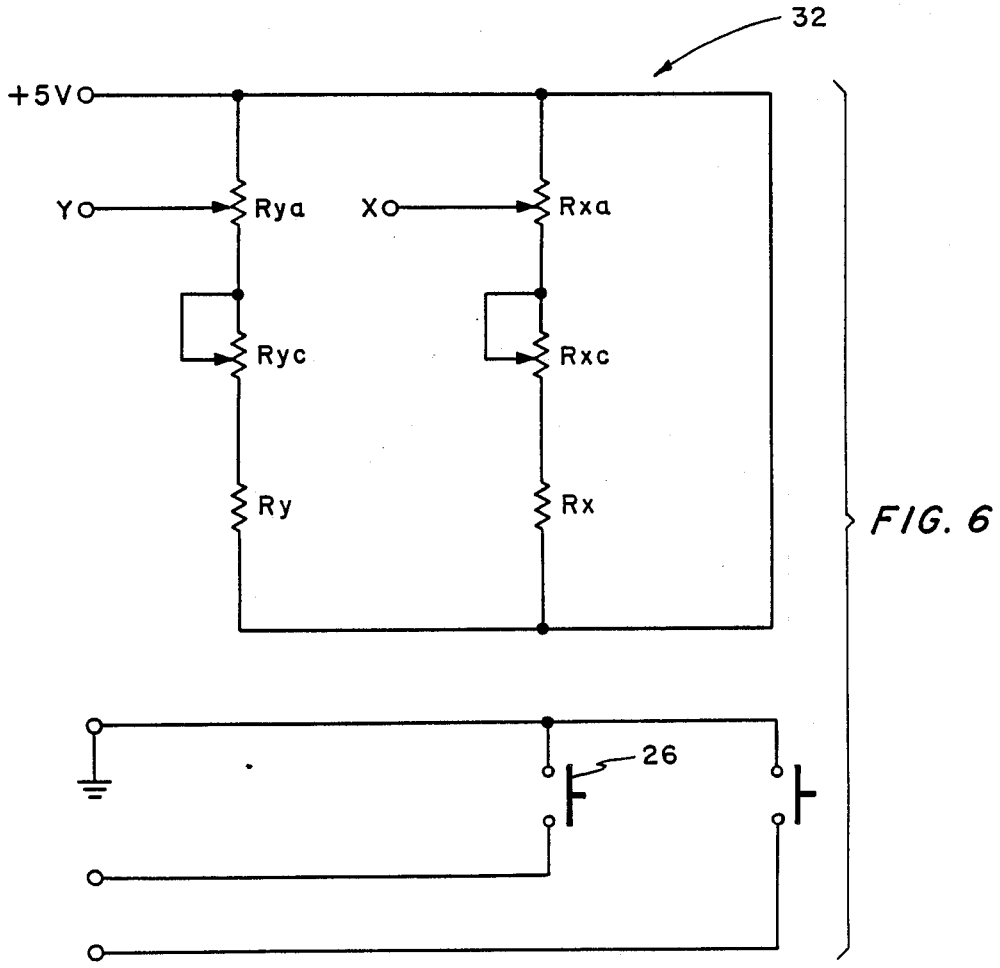
FIG. 6 is a schematic representation of the circuit on the circuit board.

FIG. 5 illustrates one possible arrangement of resistors and conductors carried on a substrate and comprising the circuit board 32, and the upper portion of FIG. 6 is a schematic representation of the circuit formed by the resistors and conductors. The resistors may be any suitable resistors that are deposited, mounted or placed on the substrate such that they extend linearly along the substrate, and may comprise, by way of example, screen resistors. Included are a pair of resistors $R_{xa}$ and $R_{ya}$ from which are derived analog signals representative of x-y axis coordinate information; a pair of resistors $R_{xc}$ and $R_{yc}$ that are adjustable in value, by means of respective levers 58 and 60, to provide a centering function for the analog output signals when the handle is in a neutral position; and a pair of fixed resistors $R_x$ and $R_y$. Also included in the circuit is an input for receiving a positive operating voltage, such as +5V, along with a pair of output terminals X and Y at which appear the analog signals representative of the x-y axis coordinate information.

To generate at the output X an analog signal representative of an x-axis coordinate, one brush 40 carried by the brush plate 34 spans a gap between and contacts both the linearly extending resistor $R_{xa}$ and a conductor $C_x$ lying parallel to the resistor and extending to the X output. Consequently, linear movement of the brush plate 34 by the handle 20 moves its brush 40 linearly along the resistor $R_{xa}$ and conductor $C_x$ to change the effective value of the resistor and provide a corresponding change in value of the signal at the output X. In a similar manner, to generate at the output Y a signal representative of a y-axis coordinate, a brush 40 carried by the brush plate 36 spans a gap between and contacts both the linearly extending resistor $R_{ya}$ and a conductor $C_y$ lying parallel to the resistor and extending to the output Y. Thus, the value exhibited by the resistor $R_{ya}$, and therefore the value of the signal at the output Y, is controlled by linear movement of the brush 40 along the resistor and conductor in response to movement of the handle.

The values exhibited by the linearly extending x-y axis centering resistors $R_{xc}$ and $R_{yc}$ are controlled in a somewhat similar manner. The lever 58 carries on its inner lower end an electrical brush (not shown) that spans a gap between and contacts both the x-axis centering resistor $R_{xc}$ and a parallel conductor $C_{xc}$, whereby linear movement of the lever adjusts the value exhibited by the resistor and performs an x-axis centering function. The lever 60 also carries an electrical brush (not shown) on its lower inner surface, which spans a gap between and contacts both the y-axis centering resistor $R_{yc}$ and a parallel conductor $C_{yc}$, whereby the lever may be linearly moved to adjust the value of the resistor $R_{yc}$ for y-axis centering purposes.

The use of linearly extending resistors and slidertype brushes to provide x-y axis coordinate information and to perform centering functions provides distinct advantages over conventional joystick assemblies that use rotary potentiometers for the purposes. First, the resistors may be made to be flat or substantially flat, so the joystick housing occupies a minimum of space and has a minimum thickness for maximum stability against tipping in use, even when the handle is relatively vigorously moved to extreme positions. Secondly, the resistors may be formed on the substrate very economically, so as compared with joystick assemblies using discrete rotary potentiometers, the one of the invention may be manufactured at minimal cost. Also, because all motions are linear and there is no need to convert linear motions to rotary motions, minimum numbers of components are required, which increases the reliability and decreases wear of the joystick, and further reduces its cost.

If desired, in addition to providing analog coordinate information, the joystick of the invention may also include buttons for activating switches that initiate events such as "fire" signals, such for example as the handle switch 26 and another switch (not shown) which may be supported on the upper casing 22, which switches are represented schematically in the lower portion of FIG. 6.

While embodiments of the invention have been described in detail, various modifications and other embodiments thereof may be devised by one skilled in the art without departing from the spirit and scope of the invention, as defined in the appended claims.

What is claimed is:

1. A joystick controller, comprising a casing; a pair of members mounted in said casing, each slidable along a linear path orthogonally with respect to the other; a handle coupled to said casing and to said members, said handle being universally pivotable about a portion of a spherical are to move said members linearly by an amount in accordance with the component of displacement of said handle along the directions of movement of said corresponding members; and a pair of transducers, each for generating a signal representative of the position of a corresponding one of said members and each including a linearly extending resistor, a discrete conductor extending parallel to said resistor and an electrical contactor carried by said corresponding one of said members for linear movement therewith in sliding simultaneous electrical contact with said resistor and discrete conductor, said resistor and discrete conductor of each said transducer being carried on a surface of a substrate in parallel side-by-side and spaced relationship on the same side of said contactor of said corresponding member and said contactor extending between and contacting both of said resistor and discrete conductor simultaneously, said corresponding member being linearly movable across said substrate surface to move said contactor slidably linearly along said resistor and discrete conductor to change the value of the signal generated by said transducer.

2. A joystick controller as in claim 1, wherein said signals generated by said transducers are discrete signals appearing on said discrete conductors.

3. A joystick controller as in claim 2, wherein said electrical contactor comprises a wiper-type brush.

4. A joystick controller, comprising a casing; first and second members mounted in said casing, each slidable along a linear path orthogonally with respect to the other; a handle coupled to said casing and to said members, said handle being universally pivotable about a portion of a spherical are to move said members linearly by an amount in accordance with the component of displacement of said handle along the directions of movement of said corresponding members; and transducer means for generating signals representative of the positions to which said members are moved by said handle, said transducer means including a circuit board having first and second linearly extending resistors on a surface thereof and first and second discrete conductors on said surface spaced from and extending parallel to said first and second transducer, respectively, and first and second wiper contacts respectively carried by said first and second members for linear movement therewith across said surface, said first wiper contact extending between and electrically contacting said first resistor and first discrete conductor and said second wiper contact extending between and electrically contacting said second resistor and second discrete conductor, said first and second members moving said first and second wiper contacts linearly along their associated first and second resistors and discrete conductors, said signals generated by said transducer means being discrete signals appearing on said first and second discrete conductors.

5. A joystick as in claim 4, wherein said discrete signals appearing on said first and second discrete conductors represent x-y coordinate information and said circuit board includes third and fourth linearly extending resistors in series with said first and second resistors, respectively, and third and fourth discrete conductors extending parallel to but spaced from and connected to one end of said third and fourth resistors, respectively, and further including third and wiper contacts respectively extending between and electrically contacting said third resistor and third conductor and between and electrically contacting said fourth resistor and fourth conductor, and means coupled with said third and fourth wiper contacts for manually sliding the same linearly along their associated conductors and resistors to change the values exhibited by said third and fourth resistors and thereby the values of said signals appearing on said first and second conductors, said third and fourth resistors being adjustable, when said handle is in a reference position, to adjust said signals to values representing selected x-y coordinate information.

6. A joystick as in claim 5, said circuit board further including a fifth resistor in series with said first and third resistors and a sixth resistor in series with said second and fourth resistors.

7. A joystick as in claim 6, said circuit board further including conductor means for connecting opposite ends of said first, third and fifth series connected resistors, and of said second, fourth and sixth series connected resistors, to a common potential.

8. A joystick as in claim 6, said circuit board further including conductor means for connecting opposite ends of said first, third and fifth series connected resistors, and of said second, fourth and sixth series connected resistors, to a common potential.

9. A joystick as in claim 5, said circuit board further including a fifth resistor in series with said first and third resistors and a sixth resistor in series with said second and fourth resistors.

10. A joystick controller, comprising a casing; first and second members mounted in said casing, each slidable along a linear path orthogonally with respect to the other; a handle coupled to said casing and to said members, said handle being universally pivotable about a portion of a spherical arc to move said members linearly by an amount in accordance with the component of displacement of said handle along the directions of movement of said corresponding members; and transducer means for generating signals representative of the positions to which said members are moved by said handle, said transducer means including a circuit board having first and second linearly extending resistors on a surface thereof and first and second conductors on said surface spaced from and extending parallel to said first and second resistors, respectively, and first and second wiper contacts respectively carried by said first and second members for linear movement therewith across said surface, said first wiper contact extending between and electrically contacting said first resistor and first conductor and said second wiper contact extending between and electrically contacting said second resistor and second conductor, said first and second members moving said first and second wiper contacts linearly along their associated first and second resistors and conductors, said signals generated by said transducer means appearing on said first and second conductors and representing x-y coordinate information and said circuit board including third and fourth linearly extending resistors in series with said first and second resistors, respectively, and third and fourth conductors extending parallel to but spaced from and connected to one end of said third and fourth resistors, respectively, and further including third and fourth wiper contacts respectively extending between and electrically contacting said third resistor and third conductor and between and electrically contacting said fourth resistor and fourth conductor, and means coupled with said third and fourth wiper contacts for manually sliding the same linearly along their associated conductors and resistors to change the values exhibited by said third and fourth resistors and thereby the values of said signals appearing on said first and second conductors, said third and fourth resistors being adjustable, when said handle is in a reference position, to adjust said signals to values representing selected x-y coordinate information.

* * * * *